US006280150B1

(12) United States Patent
Miyazawa

(10) Patent No.: US 6,280,150 B1
(45) **Date of Patent: *Aug. 28, 2001**

(54) VARIABLE DISPLACEMENT PUMP

(75) Inventor: Shigeyuki Miyazawa, Saitama (JP)

(73) Assignee: Jidosha Kiki Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/133,431

(22) Filed: Aug. 13, 1998

(30) Foreign Application Priority Data

Sep. 18, 1997 (JP) ..... 9-253991

(51) Int. Cl.[7] ..... F04B 49/00
(52) U.S. Cl. ..... 417/220; 417/310
(58) Field of Search ..... 417/220, 310, 417/30, 26, 27

(56) References Cited

U.S. PATENT DOCUMENTS 4,421,462 * 12/1983 Ohe ..... 417/310
5,141,418 * 8/1992 Ohtaki et al. ..... 418/26
5,290,155 * 3/1994 Snow et al. ..... 418/82
5,538,400 * 7/1996 Konishi et al. ..... 417/220
5,562,432 * 10/1996 Semba et al. ..... 418/28

FOREIGN PATENT DOCUMENTS 53-130505 11/1978 (JP) .
56-143383 11/1981 (JP) .
58-93978 6/1983 (JP) .
63-14078 4/1988 (JP) .
5-278622 10/1993 (JP) .
7-243385 9/1995 (JP) .

* cited by examiner

*Primary Examiner*—Henry C. Yuen
*Assistant Examiner*—Mahmoud M Gimie
(74) *Attorney, Agent, or Firm*—Sughrue, Mion, Zinn, Macpeak & Seas, PLLC

(57) ABSTRACT

A cam case 23 is provided which swingably supports a cam ring 34 fitted to a rotor 33 having a vane 33*a* to form a pump chamber 36 from the outer surface such that the cam ring 34 is swingably supported by a swingable pin 35 disposed in the axial direction as a fulcrum, the cam case 23 serving as an intermediate body. Pump bodies are disposed on the two ends of the cam case in the axial direction. Moreover, a front body 21 and a rear body 22 for rotatively supporting a rotational shaft 40 of the rotor are disposed. A low-pressure chamber 80 for introducing low-level hydraulic pressure is formed at a position between the backside of the pressure plate and the front body, the position opposing a suction-side region 36A of the pump chamber.

5 Claims, 15 Drawing Sheets

VARIABLE DISPLACEMENT PUMP

BACKGROUND OF THE INVENTION

1. Field of the Invention

The present invention relates to a variable-displacement vane pump for use in an apparatus using pressurized fluid, such as a power steering unit for reducing force required to steer a steering wheel of an automobile.

2. Description of the Related Art

As a pump for a power steering unit, a positive-displacement vane pump has usually been employed which is directly operated by an engine of an automobile. The discharge flow rate of the foregoing positive displacement pump is changed to correspond to the number of revolutions of the engine. Therefore, the positive displacement pump has a characteristic which is mutually contradictory to auxiliary steering force which must be provided for the power steering unit. The auxiliary steering force must be enlarged when the automobile is stopped or the automobile runs at low speed and reduced when the automobile runs at high speed. Therefore, the positive displacement pump must have a large capacity which enables a discharge flow rate to be maintained with which required auxiliary steering force can be obtained even if the automobile runs at low speed with a small number of revolutions of the engine. Moreover, a flow control valve must be provided which controls the discharge flow rate to be not larger than a predetermined quantity when the automobile runs at high speed with a large number of revolutions of the engine. Therefore, the positive displacement pump involves an increase in the required elements, a complicated overall structure and a complicated structure of passages. Thus, the overall size and costs cannot be reduced.

To solve the problems experienced with the above-mentioned positive displacement pump, variable-displacement vane pumps each of which is capable of reducing a discharge flow rate per revolution (cam cc/rev) in proportion to an increase in the number of revolutions have been disclosed. For example, variable-displacement vane pumps of the foregoing type have been disclosed in Japanese Patent Laid-Open No. 53-130505, Japanese Patent Laid-Open No. 56-143383, Japanese Patent Laid-Open No. 58-93978, Japanese Utility-Model Publication No. 63-1478, and Japanese Patent Laid-Open No. 7-243385. The foregoing variable displacement pumps do not need the flow control valve of the capacity type. Moreover, the variable displacement pump exhibits an excellent energy efficiency because waste of drive horsepower can be eliminated. Since a return to a tank can be prevented, a rise in the temperature of oil can be prevented, a rise in the temperature of oil can be prevented. Moreover, problems of leakage in the pump and deterioration in the capacity efficiency can be prevented.

An example of the foregoing variable-displacement vane pump will simply be described with reference to FIG. 16 which shows the structure of the pump disclosed in Japanese Patent Laid-Open No. 7-243385. Referring to FIG. 16, reference numeral 1 represents a pump body, 1*a* represents an adapter ring and 2 represents a cam ring provided in an elliptic space 1*b* formed in the adapter ring 1*a* of the body 1, the cam ring 2 being swingably supported through a support shaft portion 2*a* which serves as a fulcrum for a swinging operation. The cam ring 2 is urged by an urging means (compression coil spring) for urging the cam ring 2 in a direction indicated by a hollow arrow F show in FIG. 16.

Reference numeral 3 represents a rotor eccentrically accommodated at a position adjacent to an end in the cam ring 2 in such a manner that a pump chamber 4 is formed at another end. Since the rotor 3 is rotated by an external power source, the rotor 3 forwards/rearwards moves a vane 3*a* which is held such that the vane 3*a* is able to move in the radial direction. Reference numeral 3*b* represents a drive shaft for the rotor 3. The rotor 3 is rotated in a direction indicated by an arrow shown in FIG. 16.

Reference numerals 5 and 6 represent fluid-pressure chambers formed in a pair on the two outer sides of the cam ring 2, the fluid-pressure chambers 5 and 6 being arranged to serve as high and low pressure portions in the elliptic space 1*b* of the adapter ring 1*a* of the body 1. In the chambers 5 and 6, passages 5*a* and 6*a* for introducing fluid pressures across a variable metering orifice 12 provided for a pump discharge-side passage 11 for controlling the swinging operation of the cam ring 2 are opened through a spool-type control valve 10 to be described later. When the fluid pressures across the variable metering orifice 12 in the pump discharge-side passage 11 are introduced through the passages 5*a* and 6*a*, the cam ring 2 is swung to a required direction. Thus, the capacity in the pump chamber 4 is varied so that the discharge flow rate is controlled to correspond to a flow rate in the discharge portion of the pump. That is, the flow rate in the discharge portion is controlled in such a manner that the flow rate in the discharge portion is reduced in inverse proportion to enlargement of the number of revolutions of the pump.

Reference numeral 7 represents an opening (a suction port) in the suction portion of the pump, the opening 7 being opened to face a pump suction-side region 4A of the pump chamber 4. Reference numeral 8 represents an opening (a discharge port) in the pump discharge portion, the opening 8 being opened to face a pump discharge-side region 4B of the pump chamber 4. The openings 7 and 8 are provided for either of a pressure plate or a side plate (not shown), the plates being securing walls for holding a pump element incorporating the rotor 3 and the cam ring 2 from two side portions.

The cam ring 2 is urged by the compression coil spring from the fluid-pressure chamber 6, as indicated with symbol F shown in the drawing. The cam ring 2 is pressed in a direction in which the capacity in the pump chamber 4 is maximized. Reference numeral 2*b* shown in the drawing represents a sealing member provided on the outer surface of the cam ring 2 so as to define the fluid-pressure chambers 5 and 6 in association with a bearing portion 2*a*, the chambers 5 and 6 being defined on the right-hand and left-hand portions in the pump chamber 4.

Reference numerals 7*a* and 8*a* represent whisker-like notches formed continuously from ends of the opening 7 in the pump suction portion and the opening 8 in the pump discharge portion. When a pumping operation is performed by rotating the rotor 3 so that the leading end of each vane 3*a* is slid on the inner surface of the cam ring 2, the notches 7*a* and 8*a* gradually relieve the fluid pressure from the high pressure portion to the low pressure portion in a region from a space adjacent to the ends of the openings 7 and 8 and held between the vanes to a space between the vanes adjacent to the foregoing space. Thus, surge pressure and pulsation are prevented.

The spool-type control valve 10 is operated by dint of different pressures P1 and P2 across a variable metering orifice 12 disposed at an intermediate position of the pump discharge-side passage 11. When fluid pressure P3 corresponding to the flow rate in the discharge portion of the pump is introduced into the fluid-pressure chamber 5 at a position on the outside of the cam ring 2, a sufficiently high flow rate can be maintained in the initial stage of the operation of the pump. In particular, in a state where the different pressure across the variable orifice 12 is raised to be a level not lower than a predetermined level when a load is applied because of the operation of the apparatus using the fluid pressure, the control valve 10 introduces the fluid pressure P1 upstream of the variable orifice 12 into the high-pressure-side fluid-pressure chamber 5 on the outside of the cam ring 2, the fluid pressure P1 being introduced as control pressure. Thus, any swing of the cam ring 2 can be prevented.

The variable-displacement vane pump having the above-mentioned structure incorporates elements, for example, the body 1, each having a complicated structure. What is worse, a large number of elements must be provided. Thus, there arises a problem in that each element cannot easily be machined and assembled. Moreover, the size and weight of the pump cannot easily be reduced. Thus, the foregoing pump is susceptible to improvement.

The conventional variable displacement pump has a structure that a pressure plate is disposed to an end of the rotor 3 and the cam ring 2 which constitute the pump chamber 4 in the body 1. A discharge chamber into which pressurized oil discharged from the pump chamber is introduced is formed on the backside of the pressure plate. The discharged pressure from the discharge chamber of the pump causes the pressure plate to be brought into contact with the cam ring 2 and the rotor 3 under a predetermined pressure. Thus, the pump chamber 4 is formed between an end surface of a portion of the side plate or the pump body 1 disposed opposite to the cam ring 2 and the rotor 3. As a result, hydraulic oil can be sucked into the pump chamber 4 and discharged from the same.

The above-mentioned variable displacement pump is different from a usual positive displacement vane pump in that the pump chamber 4 is composed of a pump suction-side region 4A and a pump discharge-side region 4B which are disposed at asymmetric positions with respect to the rotational shaft 3*b*. On the other hand, an annular recess is formed on the backside of the foregoing pressure plate except for the portion including the rotational shaft 3*b*. The foregoing recess is formed into a discharge chamber into which pressurized oil discharged from the discharge portion of the pump is introduced.

Therefore, the discharged pressure from the inside portion of the discharge chamber acts on substantially the overall back surface of the pressure plate because of the annular recess. Since the pump suction-side region 4A of the pump chamber 4 is formed eccentrically, great force for pressing the pressure plate against the pump chamber 4 acts on the above-mentioned portion. If the eccentric force acts on the plate, the portion is deformed. As a result, there is apprehension that the plate is excessively pressed against the cam ring 2 and the rotor 3.

Therefore, the pressure plate is required to have rigidity capable of during the eccentric force.

If the pressure plate is deformed, a gap is formed between the cam ring 2 and the rotor 3. What is worse, an amount of internal leakage of pressurized oil is enlarged when the pressure is high. Therefore, a countermeasure must be taken.

As described above, the above-mentioned variable displacement pump is required to have a completely modified overall structure, to enable the structures of the elements to be simplified, the number of the elements to be reduced, the machining and assembling processes to be performed easily, reliability of the operation of the pump to be improved and the size, weight and cost of the pump to be reduced.

SUMMARY OF THE INVENTION

In view of the foregoing, an object of the present invention is to provide a variable displacement pump arranged such that the overall structure including a pump body is modified, pressure balance is kept between the two sides of the pressure plate disposed between the pump chamber and the discharge-side chamber of the pump and deformation of the plate is prevented so that excessive contact of the plate with the cam ring and the rotor is prevented and thus an mount of internal leakage in the pump is prevented.

To achieve the above-mentioned object, according to one aspect of the present invention, there is provided a variable displacement pump comprising: a cam ring for forming a pump chamber from a rotor in a state in which the rotor having a vane is moved to an eccentric position; a cam case mounted on a portion around the cam ring to swingably support the cam ring such that a swingable pin axially disposed in a portion of an outer periphery of the cam ring in a circumferential direction of the cam ring serves as a fulcrum so that the capacity of the pump chamber is changed, the cam case urging the cam ring in a direction in which the capacity of the pump chamber is maximized; front and rear bodies between which the cam case serving as an intermediate body is disposed and which are disposed on the two sides in the axial direction of the cam case so as to form a pump body; a rotational shaft pivotally supported by the two bodies so as to rotate the rotor; and a pressure plate disposed on the inside of the front body at a position at which the pressure plate is in contact with a portion adjacent to the cam case so as to introduce pressurized oil in a discharge portion of the pump to a back surface of the pressure plate, wherein a low pressure chamber for introducing low level oil pressure is formed between the back surface of the pressure plate and the front body at a position opposite to a suction region of the pump chamber.

The low pressure chamber is provided for the back side of the pressure plate or the front body.

The present invention has the low pressure chamber formed on the backside of the pressure plate at a position opposite to the suction region of the pump chamber. Thus, hydraulic pressure balance can be kept on the two sides of the pressure plate. Thus, deformation of the plate can be prevented.

A recess portion for forming the low pressure chamber is sealed with a sealing member, such as an "O" ring so that separation from the discharge-side pressure chamber (a discharge chamber) formed on the backside of the pressure plate is performed.

The variable displacement pump is a vane-type oil pump for discharging hydraulic pressure. For example, the variable displacement pump is employed as an oil pressure source adaptable to, for example, a power steering unit for a vehicle. The present invention is not limited to this.

The cam ring is swingably supported in a space formed in the pump body by a support portion including a swingable pin having a portion which serves as a fulcrum of swinging. The cam ring is swung by dint of hydraulic pressures in first and second hydraulic pressure chambers formed on the two sides of a segment passing through the support portion and an urging means provided for the low-pressure hydraulic pressure chamber.

The pump body is constituted by the two bodies and the cam case manufactured by precise casting processes, such as aluminum die-cast. The internal passages, the internal spaces and the hole portions, such as the valve hole, are formed by casting or boring The present invention is not limited to the foregoing methods.

The shape of the shaft serving as the rotational shaft is formed into a straight shape as much as possible. The shaft serving as the rotational shaft is pivoted on each body at each position by using bushes, such as wrapping bearings each having a dual structure and made of aluminum and white metal. Thus, the shaft is supported by a two-point support structure. The present invention is not limited to the foregoing structure.

BRIEF DESCRIPTION OF THE DRAWINGS

FIG. 5B is a cross sectional view taken along line V—V shown in FIG. 5A and FIG. 5C is a diagram showing a conventional example corresponding to FIG. 5B;

FIG. 6B is a cross sectional view taken along line VI—VI shown in FIG. 6A;

FIG. 8B is a cross sectional view taken along line VIIIb—VIIIb shown in FIG. 8B and FIG. 8C is a cross sectional view taken along line VIIIc—VIIIc shown in FIG. 8A and showing an essential portion;

FIG. 10B is a side cross sectional view and FIG. 10C is a diagram showing a modification of the structure shown in FIG. 10B;

FIGS. 14A to 14C show another embodiment of the variable displacement pump according to present invention, in which FIG. 14A is a side view showing the rear body when viewed from the joining surface with the cam case, FIG. 14B is a side cross sectional view and FIG. 14C is a cross sectional view showing an essential portion of a portion for receiving a relief valve;

DETAILED DESCRIPTION OF THE PREFERRED EMBODIMENTS

Figure 1:
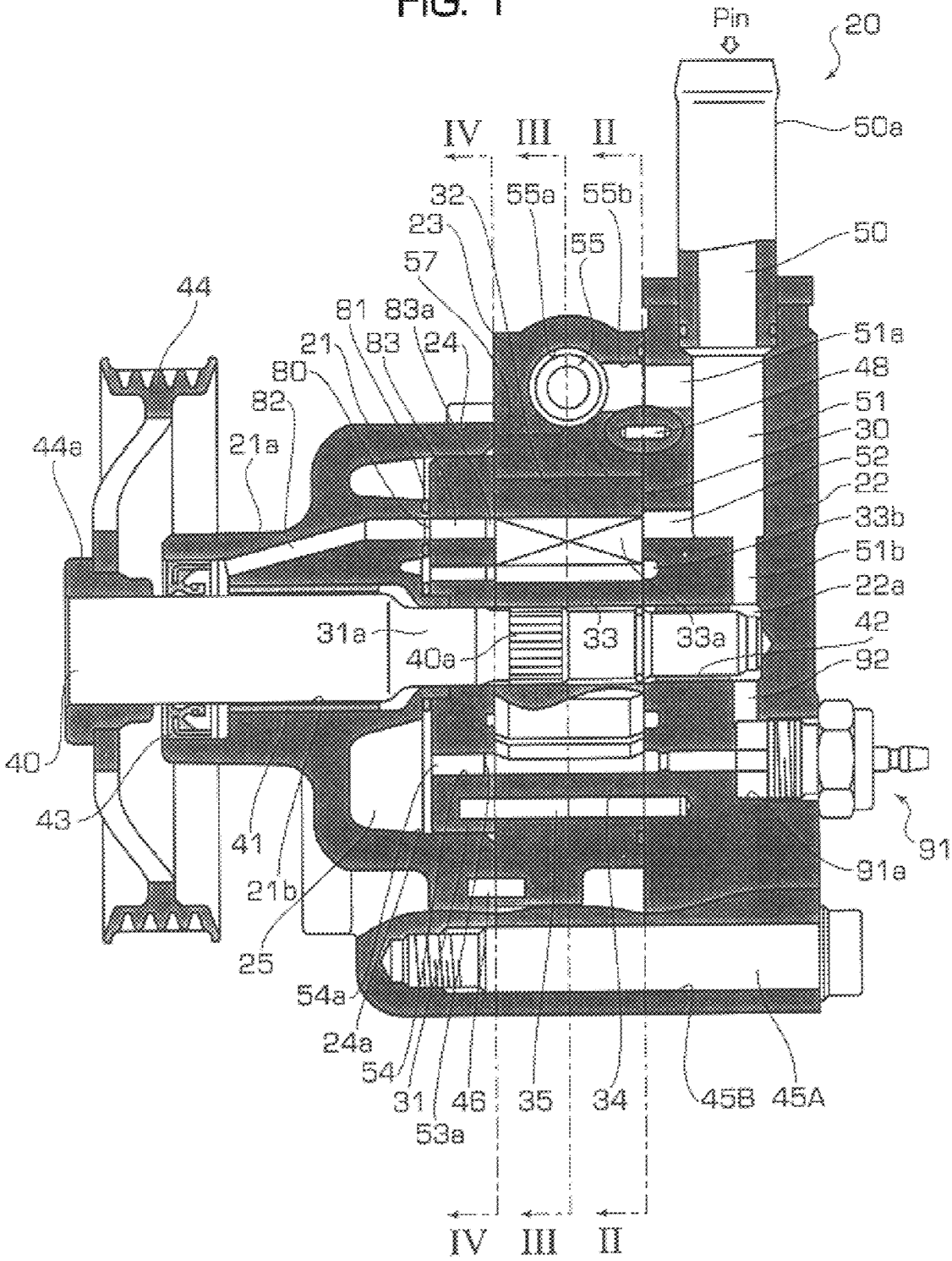
FIG. 1 is a vertical cross sectional view showing an essential portion of an embodiment of a variable displacement pump according to the present invention.

Now, a description will be given in more detail of preferred embodiments of the present invention with reference to the accompanying drawings.

FIGS. 1 to 12 show an embodiment of a variable displacement pump according to the present invention. Referring to the drawings, the variable displacement pump is a vane-type oil pump which serves as a source for generating hydraulic pressure for a power steering unit.

As shown in FIGS. 1, 4 to 9, a vane-type variable displacement pump 20 incorporates a front body 21, a rear body 22 and a cam case 23 serving as an intermediate body which forms a pump body.

As shown in FIGS. 1, 4, 5A and 5B, the front body 21 has a small-diameter portion 21*a* projecting to either end. In the central portion of the front body 21, a shaft hole 21*b* through which a rotational shaft of a rotor 33 to be described later is inserted is formed.

As shown in FIGS. 1, 4, 5A and 5B, a circular space 24 for accommodating a pressure plate 31 which is one of pump elements 30 is formed in the joining surface of the front body 21 in the large-diameter portion with which the cam case 23 is joined. Moreover, an annular recess 24*a* is formed at the back of the circular space 24. The annular recess 24*a* is formed in such a manner that a discharge chamber 25 is formed between a pressure plate 31 to be described later and the annular recess 24*a*, the discharge chamber 25 being a chamber into which pressurized oil in the discharge portion of the pump is introduced.

As shown in FIGS. 1, 2, 3, 5A–5C, 6A–6B and 7, the cam case 23 has, in the central portion thereof, an accommodating space 32 for accommodating a pump cartridge which is the pump element 30. The accommodating space 32 has an ellipse-like shape extending to the right and left in FIGS. 2 and 3. The accommodating space 32 swingably supports a cam ring 34 mounted on a portion around a rotor 33 in a state where the rotor 33 having a vane 33*a* is moved eccentrically to either side such that a swingable pin 35 disposed in a portion in the circumferential direction and placed in the axial direction is used as a fulcrum. Thus, the capacity of the pump chamber 36 can be varied.

The cam ring 34 forms a pump chamber 36 between an inner surface and an outer surface of the rotor 33. The cam ring 34 is urged in a direction in which the capacity of the pump chamber 36 is maximized by a compression coil spring 37 disposed on either side of the cam case 23 and serving as an urging means.

Figure 16:
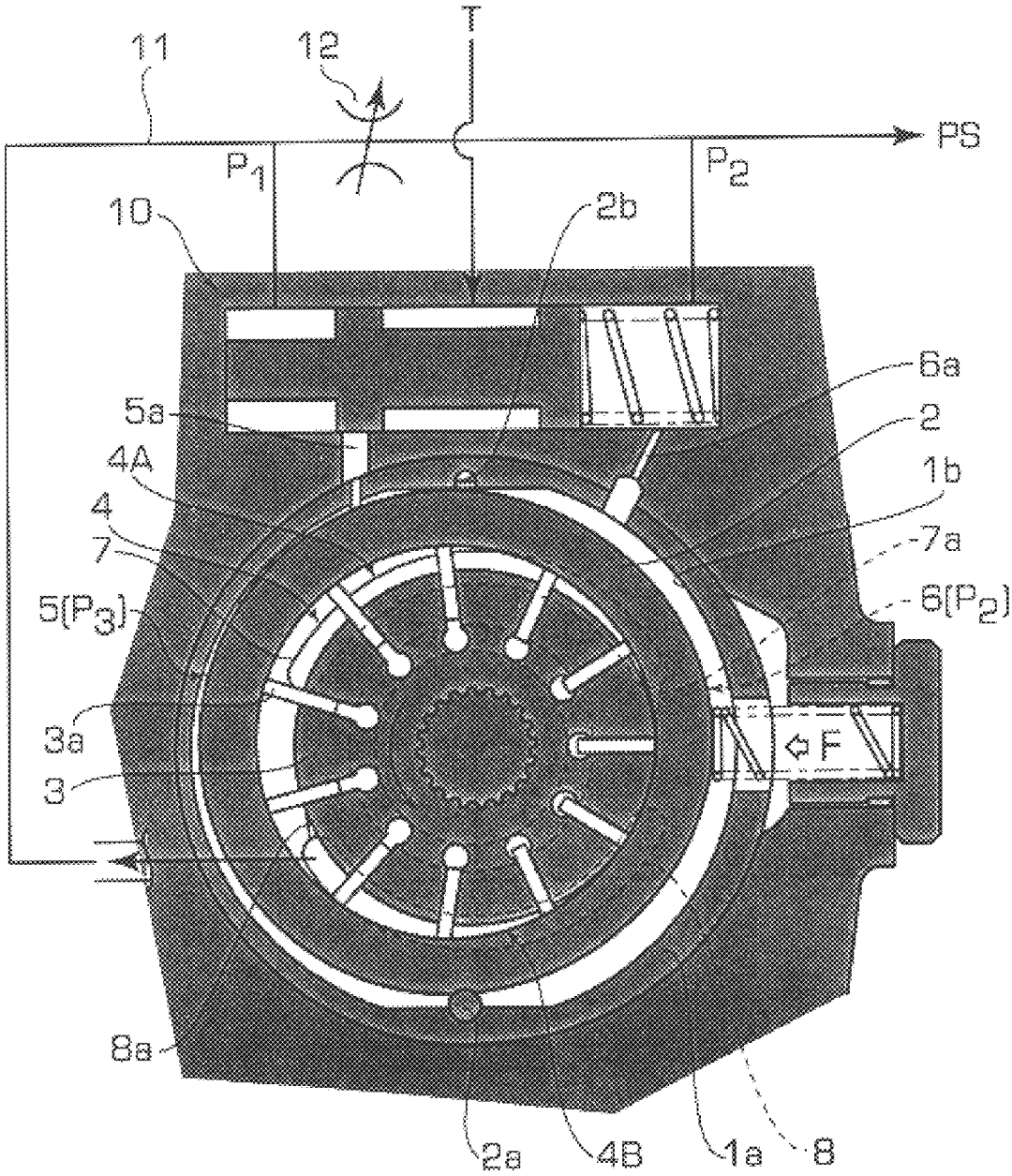
FIG. 16 PRIOR ART
FIG. 16 is a diagram showing the structure of an essential portion of a conventional variable displacement pump.

The cam case 23 is a member corresponding to an adapter ring (1*a* shown in FIG. 16) for swingably holding the cam ring 34 in the pump body. The rear body 22 is joined in contact with the rear portion of the cam case 23. In corporation with a pressure plate 31 disposed in the circular space 24 adjacent to the front body 21, the cam case 23 forms the pump chamber 36 between the rotor 33 and the cam ring 34.

Reference numeral 40 represents a drive shaft serving as a rotor for rotating the rotor 33 of the pump elements 30 from an outer position. The drive shaft 40 penetrates the front body 21 and the rotor 33. The inner end of the drive shaft 40 is received by a shaft hole 22*a* formed in the rear body 22.

As shown in FIG. 1, the drive shaft 40 is arranged to be integrally rotated with the rotor 33 by dint of serration joint (or a key joint). The drive shaft 40 is rotatively supported at two points by bushes 41 and 42 provided for shaft holes 21*b* and 22*a* of the front body 21 and the rear body 22.

The bushes 41 and 42 are wrapping bearings made of, for example, aluminum and white metal and having a dual structure. The bushes 41 and 42 are disposed for a predetermined length in the axial direction so as to rotatively support the drive shaft 40 with required strength.

Referring to FIG. 1, reference numeral 43 represents an oil seal disposed at the opened end of the small-diameter portion 21*a* of the shaft hole 21*b* of the front body 21, the shaft hole 21*b* having the bush 41. Reference numeral 44 represents a pulley 44 provided for a pulley support ring 44*a* disposed at an outer end of the drive shaft 40 by press fitting or the like. When rotative force is transmitted from an outer power source, such as a electric motor, to the pulley 44, the drive shaft 40 can be rotated.

In this embodiment, the pump body for constituting the variable displacement pump 20 incorporates the front and rear bodies 21 and 22 and the cam case 23 manufactured by precise casting, such as aluminum die-cast. The shape of the drive shaft 40 serving as the rotational shaft is formed to have the straight shape as much as possible. Moreover, the drive shaft 40 is borne at each of the front and rear bodies 21 and 22 by the bushes 41 and 42. Therefore, the following advantages can be obtained.

That is, the conventional pump has a structure that the ball bearing for bearing the drive shaft 40 is provided at a position adjacent to the pulley 44. Moreover, a needle bearing and a bush are disposed in the body. Thus, the drive shaft 40 is borne at three points. On the other hand, this embodiment has the structure that the drive shaft 40 is supported at two points by the bushes 41 and 42. Moreover, the drive shaft 40 is formed into the straight shape as much as possible. Therefore, the outer diameter of the pump body can be reduced and the number of the elements can be reduced. Thus, the cost can be reduced.

In this embodiment, the length of the bush 41 in the front body 21 in the axial direction is elongated and the bush 41 is positioned adjacent to the pulley 44 in the small-diameter portion 21*a*. Therefore, resistance against a bending load can be raised despite the small diameter of the shaft. Moreover, the load capacity (a PV value) as the pump can be enlarged. Since the drive shaft 40 is borne by the bushes 41 and 42 at the positions adjacent to the rotor 33, a problem which arises because of an eccentric load occurring due to the hydraulic pressure can be prevented.

Since the drive shaft 40 is formed into the substantially straight shape as described above, the hole 31*a* in the pressure plate 31 for introducing high hydraulic pressure into a base portion (33*b*) of the vane 33*a* can be formed into a straight shape in the axial direction in place of the conventional diagonal hole. Therefore, the passage for introducing hydraulic oil can be enlarged. Moreover, the straight hole can easily be formed in the pressure plate 31 by a machining process. When the straight hole is formed when the pressure plate 31 is manufactured by casting, the cost can be reduced.

The front body 21, the rear body 22 and the cam case 23 holding the front and rear bodies 21 and 22 are stacked in a state in which the internal elements have been accommodated. Then, the stacked elements are joined by four joining bolts 45 which are joining means so that the elements are integrally assembled. An end surface of the rear body 22 which is in contact with an end of the cam case 23 has a function to serve as a side plate of the pump elements 30.

Figure 2:
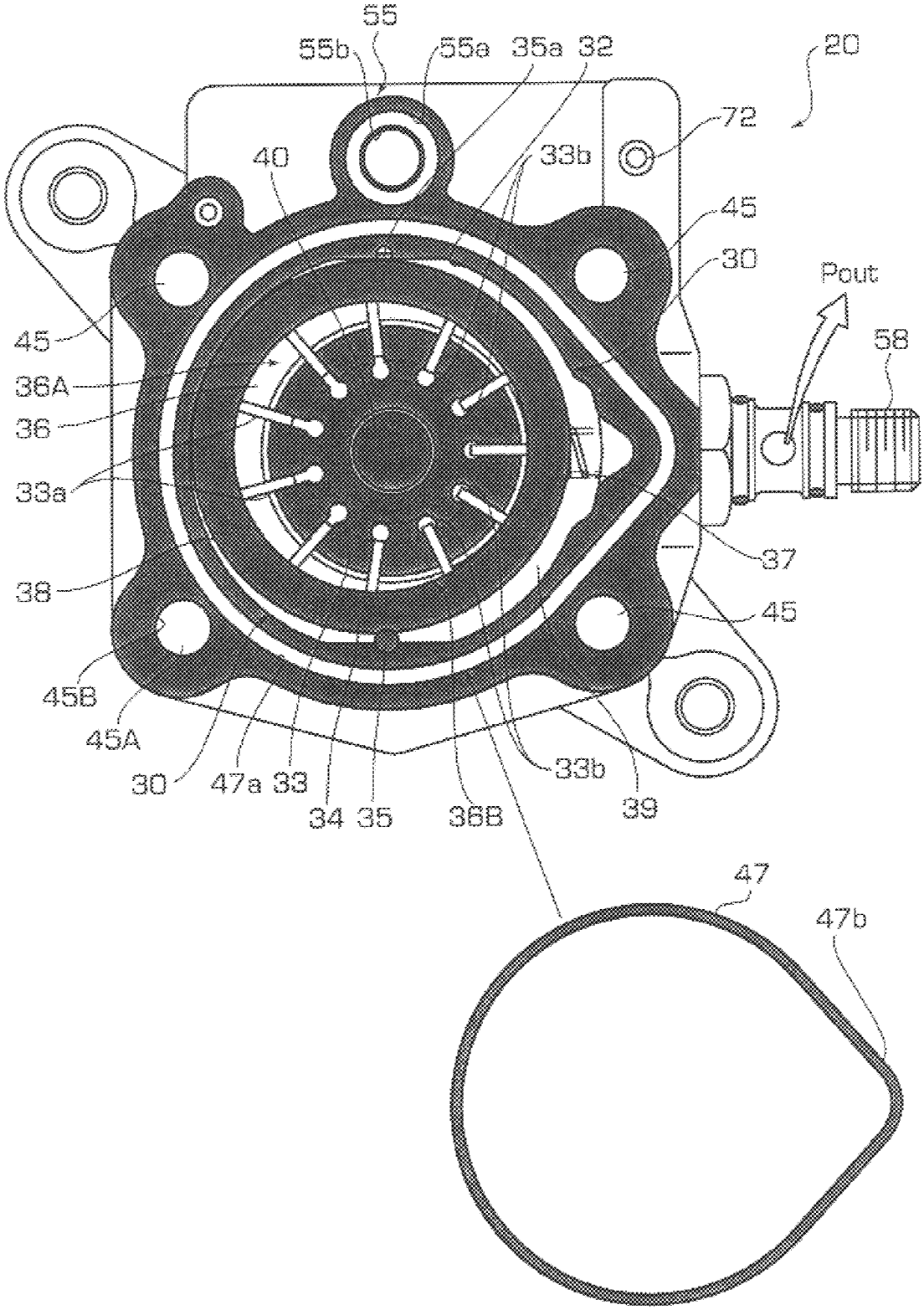
FIG. 2 is a horizontal cross sectional view taken along line II—II shown in FIG. 1 and showing a portion in the vicinity of a pump chamber of the variable displacement pump.

Referring to FIG. 2, reference numeral 47 represents an "O" ring mounted on a recess grove 47*a* formed in the side portion of the cam case 23 and arranged to seal the pump chamber 36 formed by the pump elements 30 and the first and second fluid-pressure chambers 38 and 39 for swinging the cam ring 34. The "O" ring 47 has an enlarged portion 47*b* for bypassing the relief valve 74.

In addition to the above-mentioned structure according to this embodiment, a swingable pin 35 for swingably supporting the cam ring 34 in the cam case 23 is provided as one of means for locating the three-piece structure composed of the front body 21, the rear body 22 and the cam case 23 serving as the intermediate body which is held between the front and rear bodies 21 and 22.

Since the above-mentioned structure incorporates the swingable pin 35 of the cam ring 34 which is a conventional element as the locating member, any redundant element is not required. Thus, the number of elements of the pump can be reduced and the cam case and the two bodies can reliably be located at the joining surfaces in the directions of the planes and the circumferential directions. That is, it might be considered to locate the above-mentioned members by using two means for only locating the positions, such as the locating pins. In this embodiment, the swingable pin 35 having another functions is employed as at least either of the locating means.

In this embodiment, another locating means is arranged such that a reamer bolt 45A arranged to be received in a reamer hole 45B is employed as at least one of the joining bolts 45 for joining the two bodies 21 and 22 to each other. Therefore, the number of elements can be reduced. Since the reamer bolt 45A is able to reliably bear an eccentric load generated by dint of the hydraulic pressure which acts on the two bodies 21 and 22 and the cam case 23, the reliability of the assembled pump 20 can be maintained.

In the above-mentioned embodiment, the reamer bolt 45A is employed as one of the joining bolts serving as the locating means together with the swingable pin 35. The present invention is not limited to the above-mentioned structure. For example, the structure shown in FIG. 1 may be structured such that locating pins 46 and 48 may be provided between the front body 21 and the cam case 23 and between the cam case 23 and the rear body 22. Even if the reamer bolt 45A is not provided, the two bodies 21 and 22 and the cam case 23 can easily be located and assembled. In this case, when holes formed when the two bodies 21 and 22 and the cam case 23 have been precisely cast are used as holes into which the locating pins 46 and 48 are inserted, the machining process can easily be performed. Since the joining bolts 45 is able to freely be tightened, the assembling process can easily be performed.

Although the structure shown in FIG. 1 incorporates the two locating pins 46 and 48, the present invention is not limited to this. One locating pin may be inserted into a required portion to as well as have the locating function. The essential portion lies in that the cam case 23 which is held between the front and rear bodies 21 and 22 paired with each other is located in the rotational direction and the direction of the plane in each joining surface by using the swingable pin 35 which swingably supports the cam ring 34.

Reference numeral 50 represents a suction port formed in a portion of the rear body 22. The port 50 has a suction-side pipe 50a which is a connector in the suction portion of the pump 20. Hydraulic oil for the suction portion is introduced from a tank. Hydraulic oil is allowed to pass through a suction-side passage 51 formed in the rear body 22, and then allowed to pass through a suction-side opening 52 opened in a suction-side region 36A of the pump chamber 36 formed in the cam ring 34 of the cam case 23 from the rotor 33. Then, hydraulic oil is sucked into the pump chamber 36. Then, hydraulic oil undergoes a pumping action because of the operation of the vane 33*a* so that hydraulic oil is discharged through a discharge-side opening 53 and the discharge-side passage 54 adjacent to the pressure plate 31 opened in a discharge-side region 36B. Then, hydraulic oil is, on the backside of the pressure plate 31, introduced into the discharge chamber 25 (a discharge-side pressure chamber) which is a high pressure chamber formed by the annular recess 24*a* of the front body 21.

Figure 14A:
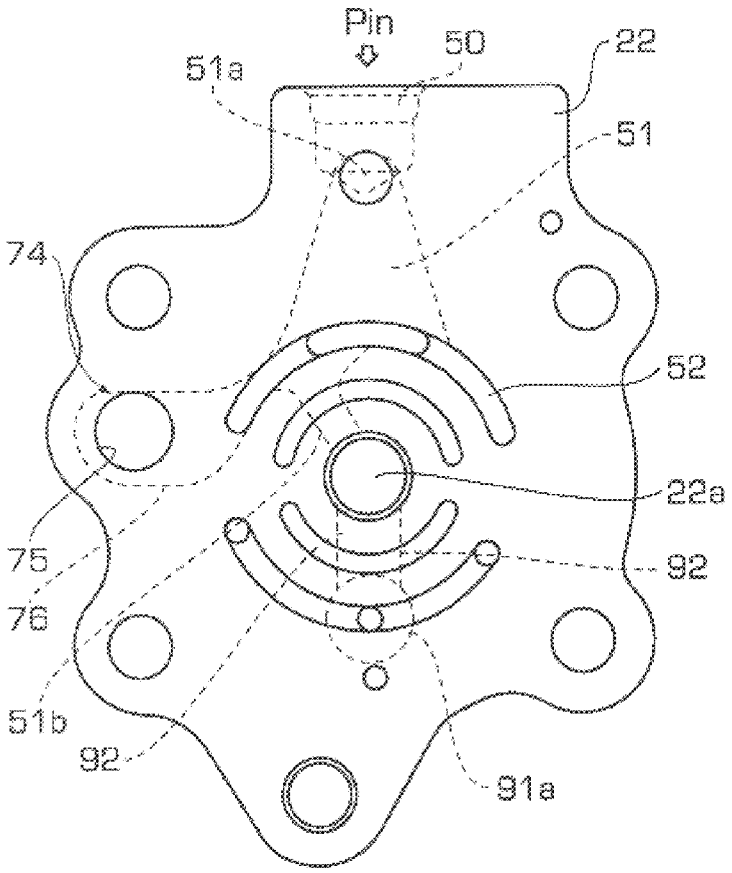
Figure 14B:
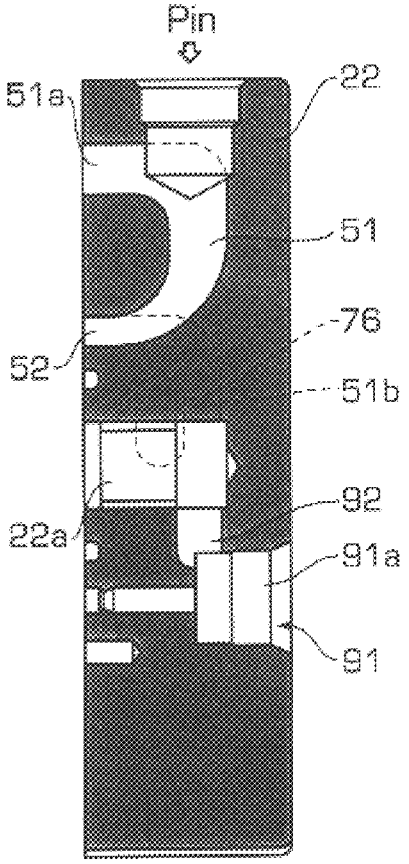
Figure 14C:
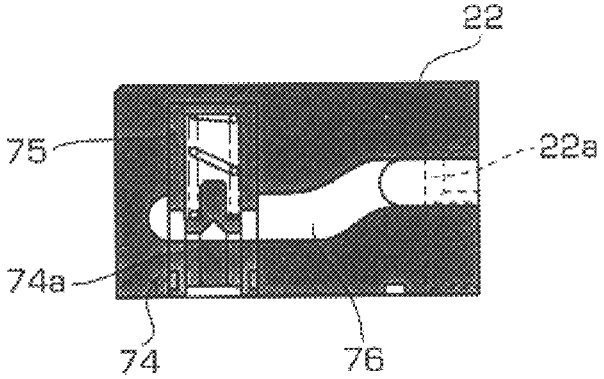

In the embodiment shown in FIGS. 1 and 8A–8C, the suction port 50 and the suction-side passage 51 in the rear body 22 are constituted by the passage holes formed by machining. The present invention is not limited to this. When holes formed by using cores when the rear body 22 is cast are employed, for example, as shown in FIGS. 14A and 14B, the machining process can easily be performed and the cost can be reduced. Since the basic structure is the same as that shown in FIG. 1, the foregoing method is omitted from description.

Figure 3:
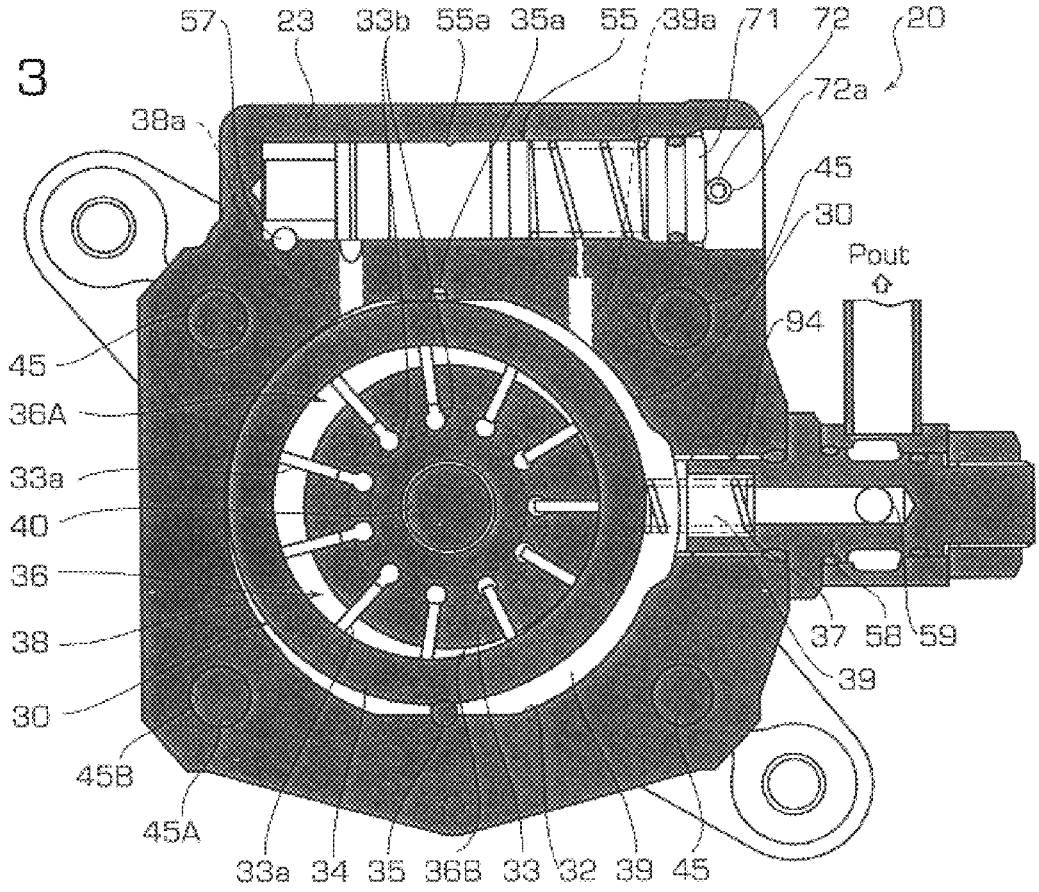
FIG. 3 is a horizontal cross sectional view taken along line III—III shown in FIG. 1 and showing the portion in the vicinity of a pump chamber of the variable displacement pump.
Figure 5A:
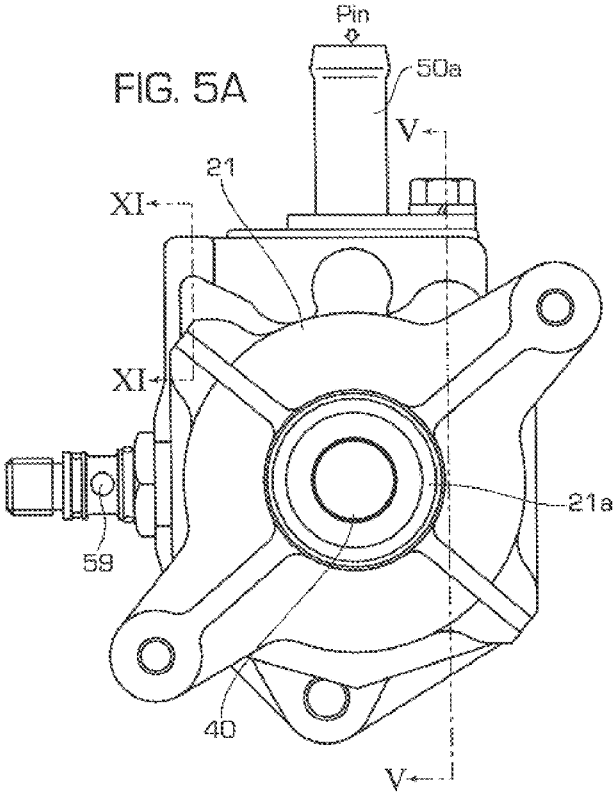
FIGS. 5A–C, 5A is a side view showing the variable displacement pump shown in FIG. 1 when viewed from the front body.
Figure 5B:
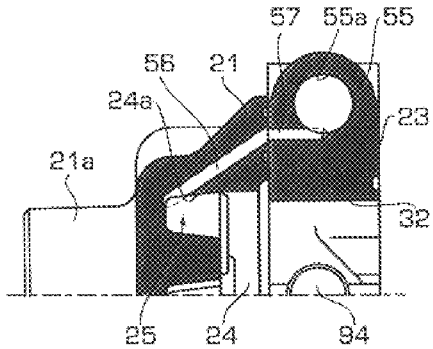
Figure 12:
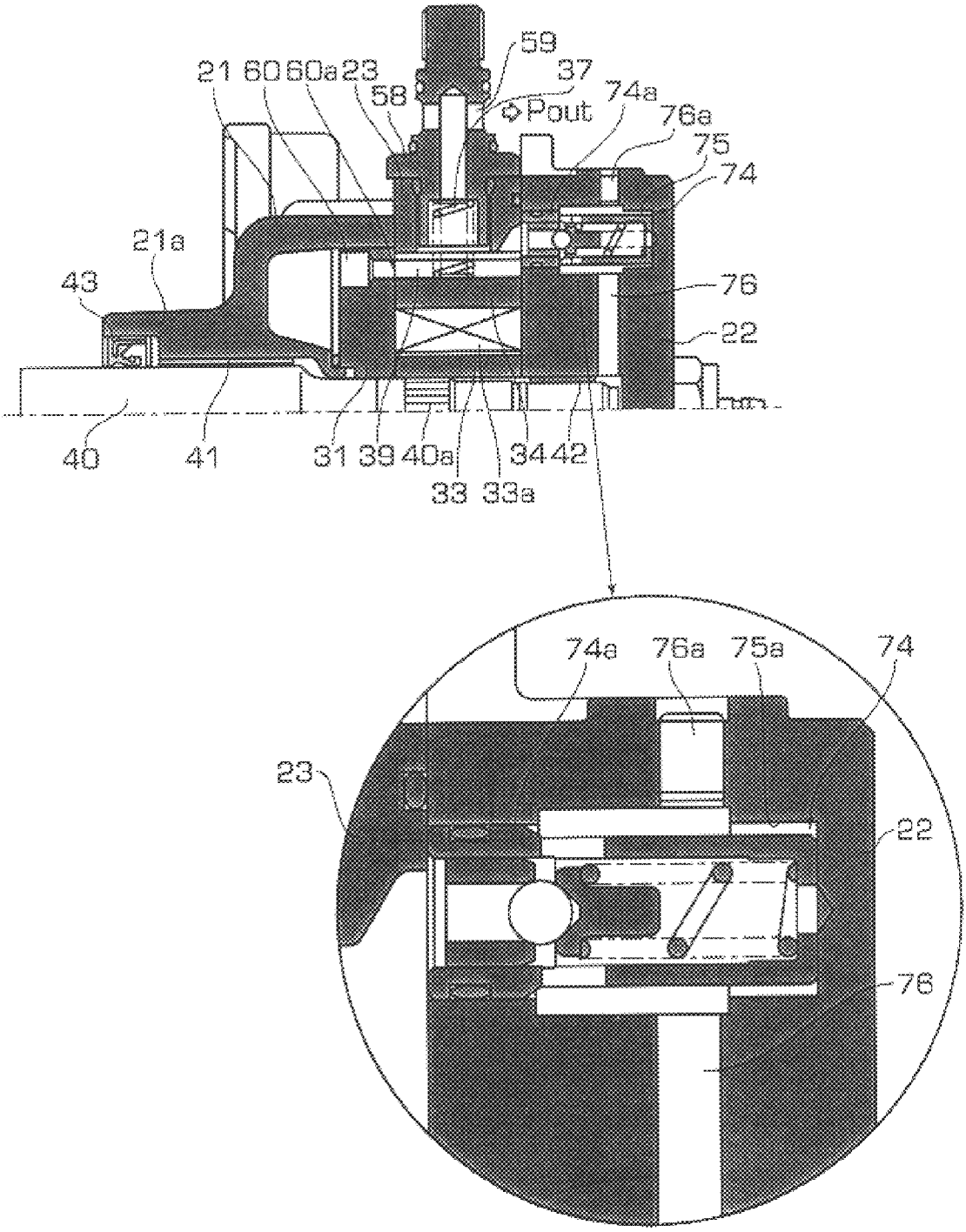
FIG. 12 is an enlarged cross sectional view taken along line XII—XII shown in FIG. 9 and showing an essential portion.

The discharge chamber 25 is, through hydraulic-pressure passages 56 and 57, connected to a high-pressure chamber of the control valve 55 formed in a portion of the cam case 23 shown in FIG. 5B and FIG. 3 and serving as the high-pressure portion. On the other, as shown in FIG. 12, hydraulic oil is allowed to pass through a discharge-side passage 60 having a metering orifice 60*a*, and then introduced into the second fluid-pressure chamber 39 and an internal passage in a discharge-side connector 58 so as to be discharged through a discharge-side port 59.

In the discharge-side passage 60, there is formed the variable metering orifice 60*a* which is capable of changing the opened area by the fluid-pressure passage hole 60 opened in the second fluid-pressure chamber 39 and the side portion of the cam ring 34. The variable metering orifice 60*a* is formed when the small-diameter opened end of the discharge-side passage 60 is opened/closed in the side wall portion because the cam ring 34 is displaced. When the amount of opening/closing of the orifice 60*a* is arranged to be controlled in accordance with the level of the fluid pressure in the discharge portion, the displacement of the cam ring 34 can be controlled as desired. Thus, the flow rate characteristic can be varied.

In this embodiment, the first and second fluid pressure chambers 38 and 39 are formed between the outer surface of the cam ring 34 and the cam-ring accommodating space 32 in the cam case 23 so as to swing the cam ring 34. Hydraulic pressure which is supplied to the first and second fluid pressure chambers 38 and 39 is controlled by a control valve 55 which is disposed in a portion of the cam case 23. The control valve 55 controls the hydraulic pressure through passage holes 38*a* and 39*a* to correspond to the flow rate of the pressurized fluid from the pump chamber 36. As shown in FIGS. 5B and 7A–7E, a hydraulic-pressure passage in the high pressure portion is constituted by a diagonal hole 56 formed from the discharge chamber 25 in the front body 21 and opened in an end surface which is a joining surface for joining the cam case 23. Moreover, also a hole 57 for establishing the connection between the end surface of the cam case 23 and the valve hole 55*a* of the control valve 55 is an element for constituting the foregoing hydraulic-pressure passage.

Figure 5C:
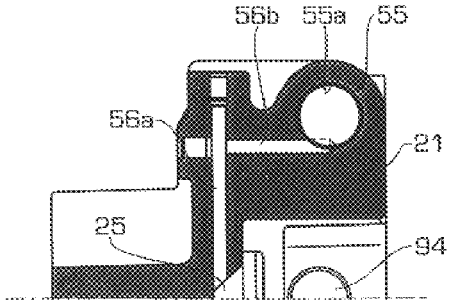
Figure 6A:
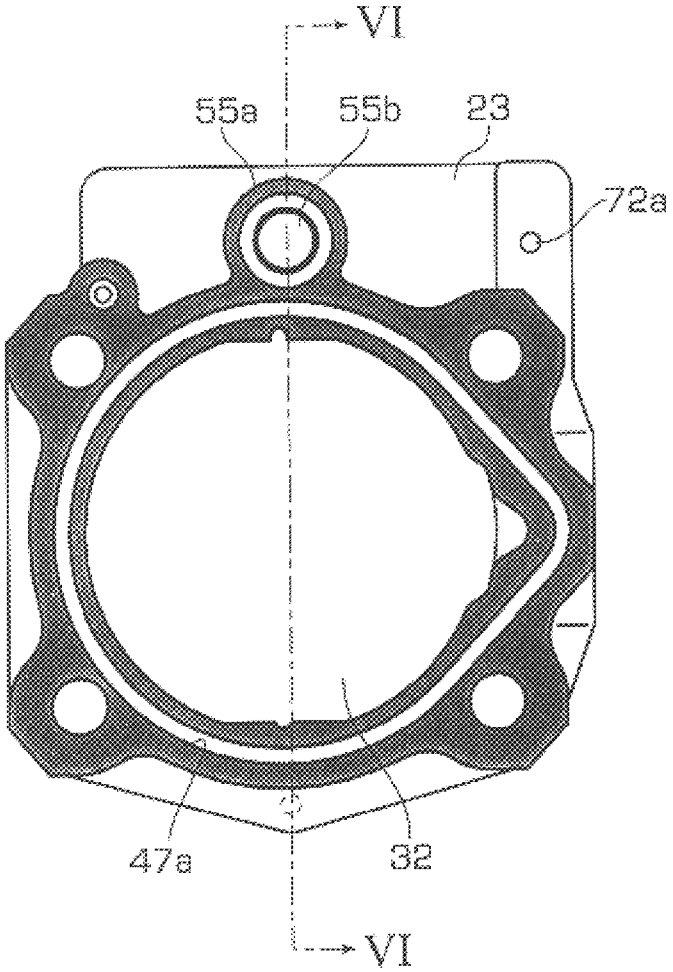
FIGS. 6A–B, 6A is a front view of a cam case of the variable displacement pump shown in FIG. 1
Figure 6B:
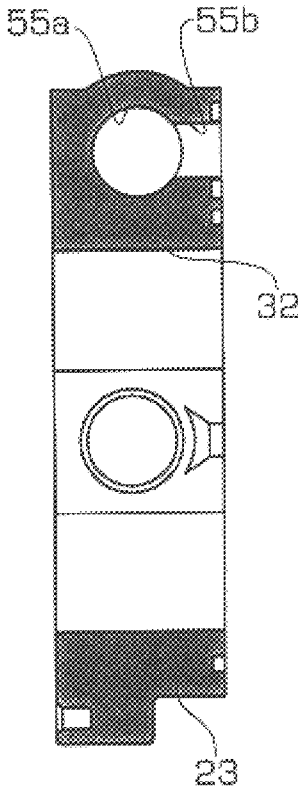
Figure 11:
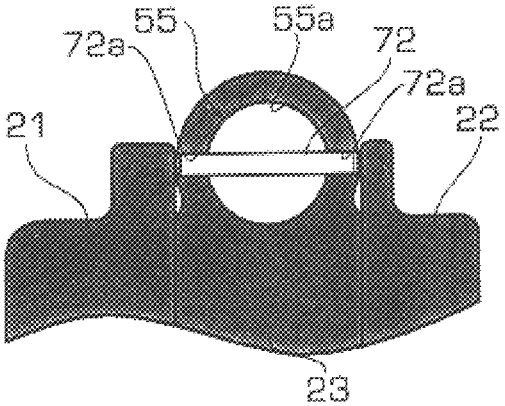
FIG. 11 is a cross sectional view taken along line XI—XI shown in FIG. 5.
Figure 7A:
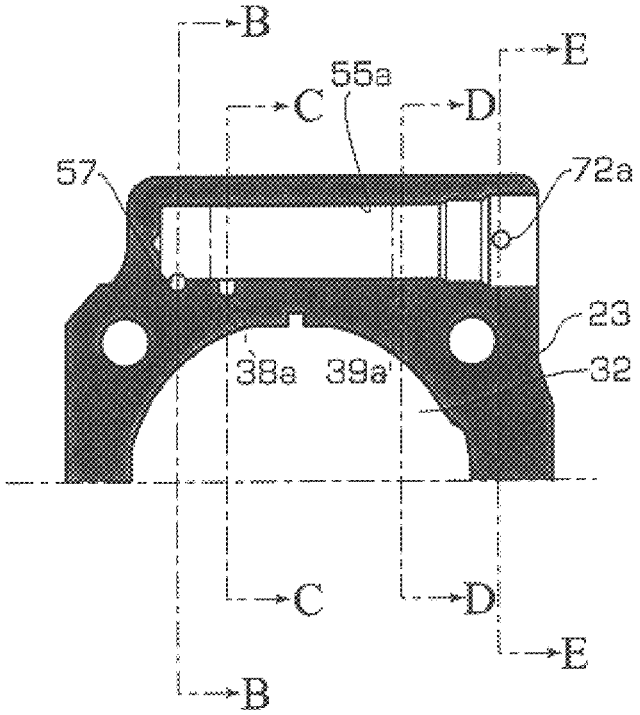
FIGS. 7A–E, 7A is a cross sectional view showing an essential portion of the cam case of the variable displacement pump shown in FIG. 1 and FIGS. 7B to 7E are cross sectional views taken along lines B—B, C—C, D—D and E—E, respectively.
Figure 7B:
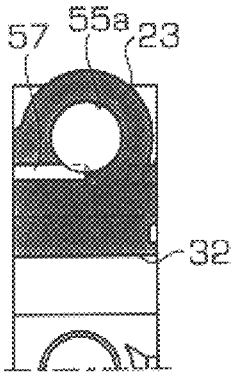
Figure 7C:
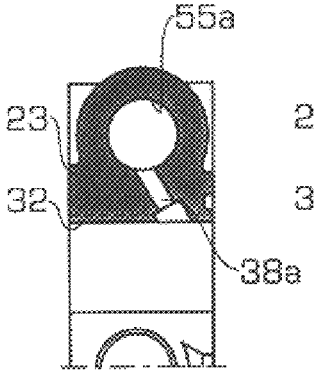
Figure 7D:
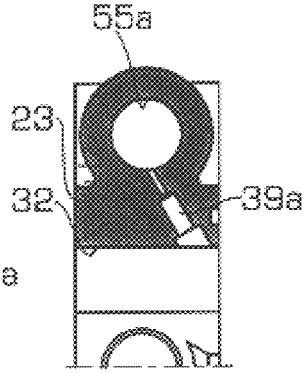
Figure 7E:
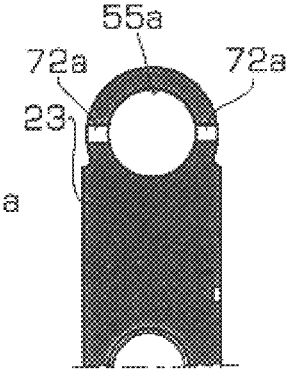

Since the above-mentioned structure is, as shown in FIG. 5C, arranged such that the high-pressure portion, such as the control valve 55, is disposed in the conventional front body 21, the high-pressure hydraulic passage for establishing the connection between the front body 21 and the discharge chamber 25 can be formed by combining the two passage holes 56*a* and 56*b* which penetrate the front body 21 through two different positions on the outer surface of the front body 21. Moreover, the structure for closing the opened ends with blind caps can be omitted. Therefore, the number of manufacturing processes can considerably be reduced and the blind caps and the like can be omitted. Thus, the cost can significantly be reduced. Since the above-mentioned structure is able to eliminate apprehension that oil leaks in the foregoing blind caps, reliability can be improved.

In the above-mentioned structure, the space for accommodating the conventional cam ring 34 and forming the first and second fluid pressure chambers 38 and 39 is created by the adapter ring inserted into the front body 21. Since the adapter ring is formed into a separate structure by the cam case 23 which serves as the intermediate body, the structure of the pump including the passages and grooves can be simplified. Thus, the passage holes and the like can easily be machined and the pump can easily be assembled.

In place of the conventional structure that the front body 21 and the rear body 22 are joined by a socket-and-spigot joint method, the rear body 22 can be formed to have a large thickness in the axial direction. Moreover, the suction port 50 can be provided for the rear side or the front side. The foregoing structure is able to improve the rigidity of the rear body 22. Since the front body 21 and the rear body 22 do not require close tolerance, the machining process can easily be performed.

Referring to FIGS. 2 and 3, reference numeral 35*a* represents a sealing member for defining the first and second fluid pressure chambers 38 and 39 formed in a pair disposed at symmetrical positions with respect to the swingable pin 35. Passage holes 38*a* and 39*a* for introducing fluid pressure across the metering orifice 60*a* from the control valve 55 are formed on the two sides of the sealing member 35*a* (see FIGS. 3, 6A–6B and 7). Moreover, a passage hole 55*b* (see FIGS. 1, 6A–6B and 8A–8C) is formed from the control valve 55 to suction-side passages 51 and 51*a*.

Since the other structures of the vane-type variable displacement pump 20 are known, the other structures are omitted from description.

In this embodiment, the spool valve is employed as the control valve 55 for controlling the fluid pressure for swinging the cam ring 34. The valve hole 55*a* for placing the spool-type control valve 55 is, as shown in FIGS. 1 and 3, formed in a direction perpendicular to the axial direction of the rotational shaft 40 such that an end of the valve hole 55*a* is outwards opened in a portion of the cam case 23. Then, the valve elements for constituting the control valve 55 are introduced into the valve hole 55*a*. Separation of a plug 71 which is a plug element is prevented as shown in FIGS. 3, 7A, 7E and 11 such that a through hole 72*a* is formed adjacent to an opened end of the valve hole 55*a* in a direction perpendicular (in the axial direction of the rotational shaft 40) to the valve hole 55*a*, the through hole 72*a* penetrating the cam case 23. Moreover, a pin, for example, a spring pin 72 is inserted into the through hole 72*a*. The two ends of the pin 72 are received by the end surfaces of the front body 21 and the rear body 22 which are joined to the two ends of the cam case 23 and which close the opened ends of the through hole 72*a*. Thus, separation is prevented.

The conventional structure is arranged such that the opened ends of the valve hole 55*a* of the spool-type control valve 55 are secured by mounting a stopper plug after the valve elements have been mounted. On the other hand, this embodiment has the structure that the simple spring pin 72 is employed to secure the opened end. Two ends of the spring pin 72 can be secured and stopped. Therefore, the thread cutting process required for the portion which receives the control valve 55 can be omitted. Moreover, the size can be reduced.

Moreover, generation of foreign matter, such as dust and iron powder, because of the conventional method of screwing the plug can be prevented. Since the spring pin 72 is employed, undesirably of the valve element can easily be prevented.

Figure 8C:
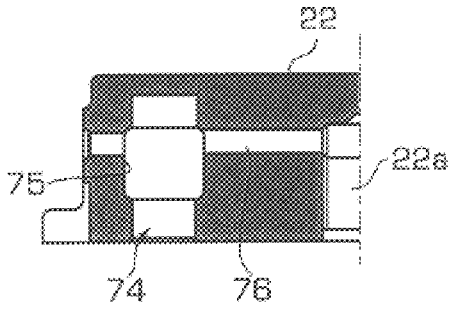
FIGS. 8A–C, 8A is a side view showing a rear body of the variable displacement pump shown in FIG. 1 when viewed from the surface for joining the cam case.
Figure 8A:
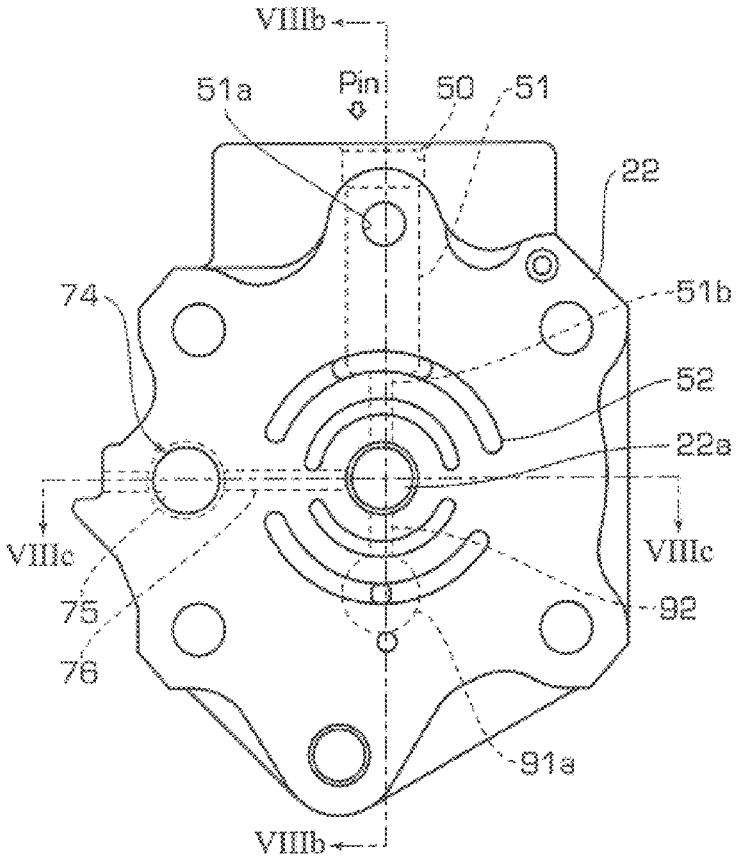
Figure 8B:
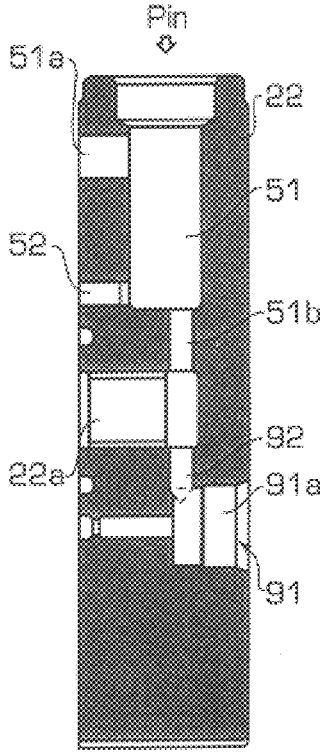
Figure 9:
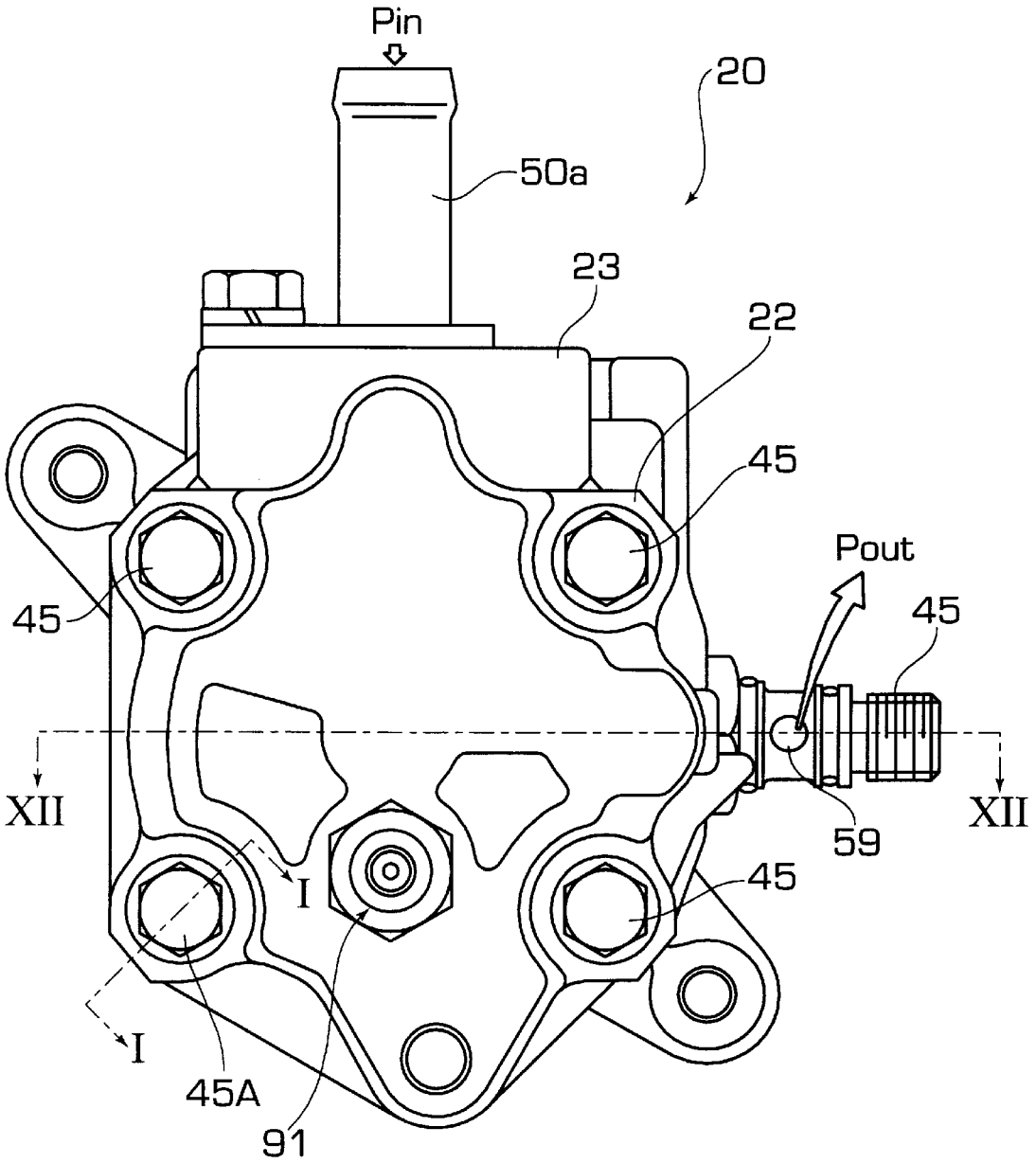
FIG. 9 is a side view showing the rear body portion of the variable displacement pump shown in FIG. 1.

In this embodiment, a relief valve 74 for relieving hydraulic oil to the suction side of the pump 20 when the fluid pressure in the discharge portion of the pump 20 is made to be not lower than a predetermined level is provided for the rear body 22 at a position between the discharge portion and the suction portion of the pump 20, as shown in FIGS. 8A, 8C and FIG. 12. That is, a valve hole 75 for receiving the relief valve 74 is formed by a blind hole having an end which is opened in the joining surface with the cam case 23 in the rear body 22. Valve elements 74*a* placed in the valve hole 75 are secured at the joining surface (or a portion of the front body 21) with the cam case 23.

A passage 76 which is connected a suction-side passage 51 in the suction side of the pump 20 through the passage hole 51*b* and the shaft hole 22*a* is connected to a portion of a valve hole 75 for the relief valve 74 in the form of a blind hole formed in the rear body 22. Reference numeral 76*a* represents a blind cap for closing an opened end formed by machining the passage 76 from the outside of the rear body 22.

A pressure detection switch 91 for detecting a state in which the fluid pressure in the discharge portion of the pump 20 has been made to be not lower than a predetermined level is disposed in a portion of the rear body 22. A passage 92 for establishing the connection between the low pressure portion of a switch hole 91*a* for receiving the pressure detection switch 91 is formed when the passage hole 51*b* is formed in the rear body 22 by machining such that the passage 92 is formed to penetrate the shaft hole 22*a*. Thus, the machining process can easily be performed and the cost can be reduced (see FIGS. 1 and 8A–8C).

The conventional structure has an arrangement that the stopper plug which is inserted into the opened end of the valve hole 75 of the relief valve 74 is a screw inserted into the opening formed in the outer surface of the rear body 22. In this embodiment, the plug is the straight plug (74*a*) having the "O" ring. Moreover, the plug 74*a* can simply be borne by the cam case 23 or the front body 21. Therefore, the overall structure of the valve 74 can be simplified. Moreover, generation of foreign matter, such as dust and iron powder experienced with the conventional stopper plug can be prevented. In addition, the movement of the plug in the axial direction can be stopped at a required position.

Since the relief valve 74 and the passages 76 and 92 for connecting the low-pressure portion of the pressure detection switch 91 to the suction-side portion of the pump 20 are provided for the rear body 22 by a simple machining process, the number of machining processes and the cost can be reduced. Although the specific structure of the pressure detection switch 91 is omitted, any one of arbitrary pressure detection switch structures, for example, disclosed in Japanese Utility-Model Publication No. 2540145 may be employed.

The first and second fluid pressure chambers 38 and 39 for swinging the cam ring 34 by dint of the fluid pressure which is introduced in accordance with the flow rate discharged from the pump chamber 36 are formed on the two sides of the position between the swingable pin 35 and an opposite position (the sealing member 35*a*) in the cam case 23. In this embodiment, the coil spring 37 serving as an urging means for urging the cam ring 34 in a direction in which the capacity in the pump chamber 36 is maximized is disposed in a hole 94 formed from the outer surface of the pump body (the cam case 23), the cam ring 34 being provided for the fluid-pressure chamber 39 of the two fluid-pressure chambers. Moreover, the discharge-side connector 58 for forming the discharge port (the discharge port 59) for the pressurized oil in the discharge portion of the pump is provided for the hole 94.

The above-mentioned structure enables the portion for receiving the coil spring 37 for urging the cam ring 34 and the discharge-side connector 58 to be used commonly. Therefore, the number of machining processes and the cost can be reduced. Moreover, the overall size of the pump can be reduced. Moreover, the cost can be reduced because the number of elements can be decreased.

Figure 4:
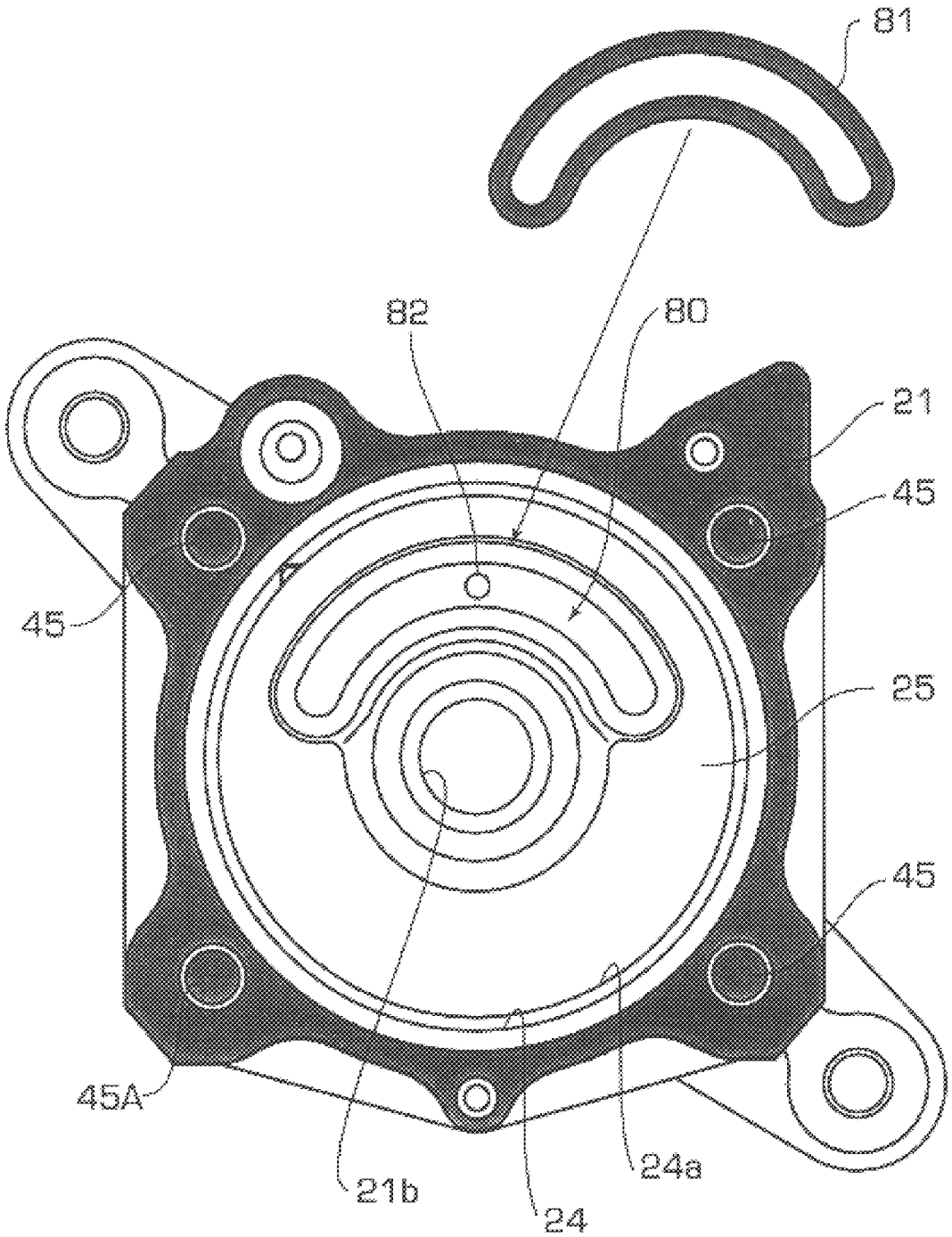
FIG. 4 is a side view taken along line IV—IV shown in FIG. 1 and showing a front body portion of the variable displacement pump.

In this embodiment, the pressure plate 31 is disposed in the inside portion of the front body 21 to be in contact with the cam case 23, the pressure plate 31 being arranged to form the discharge chamber 25 for introducing pressurized oil in the discharge portion to the backside. A low-pressure chamber 80 for introducing low pressure hydraulic oil is formed into a recess, the low-pressure chamber 80 being formed between the backside of the pressure plate 31 and the front body 21 at a position opposite to the suction-side region 36A of the pump chamber 36, as shown in FIGS. 1 and 4.

Reference numeral 81 represents an "O" ring in the form of an arc shape for sealing the low-pressure chamber 80 from the portion adjacent to the discharge chamber 25.

The above-mentioned structure is able to keep a balance of hydraulic pressure on the two sides of the pressure plate 31 which is in contact with the pump chamber 36 formed by the rotor 33 and the cam ring 34. Thus, deformation of the pressure plate 31 can be prevented.

When the ratio of the area of the recess portion which is formed into the low-pressure chamber 80 for low-pressure hydraulic pressure is determined properly, the pressure plate 31 can adequately be deformed. By using a state of the deformation, the degree of contact with the cam ring 34 which forms the pump chamber can be adjusted. Thus, internal leakage occurring when the pressure is high can be prevented.

Referring to FIGS. 1 and 4, reference numeral 82 represents a return passage for returning hydraulic oil leaked to the portion including the oil seal 43 to the suction portion of the pump 20.

Referring to FIGS. 1 and 10A–10C, reference numerals 83 and 83*a* represent recess grooves which connect the low-pressure chamber 80 with the suction portion of the pump 20 and which serve as a passage hole and an opening in the suction portion for maintaining the low pressure.

Reference numeral 31B shown in the drawings represents a shaft hole of the pressure plate 31. Reference numeral 31*c* represents a groove portion connected through the hole portion 31*a* for introducing the pressure in the discharge portion of the pump 20 into the base portion of the vane 33*a*.

Figure 10B:
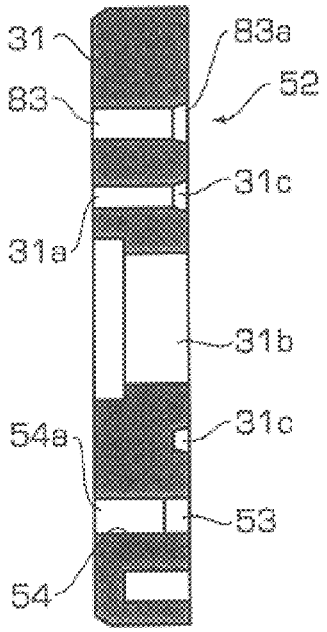
FIGS. 10A–C, 10A is a side view showing a portion of a pressure plate adjacent to a pump chamber of the variable displacement pump shown in FIG. 1.
Figure 10A:
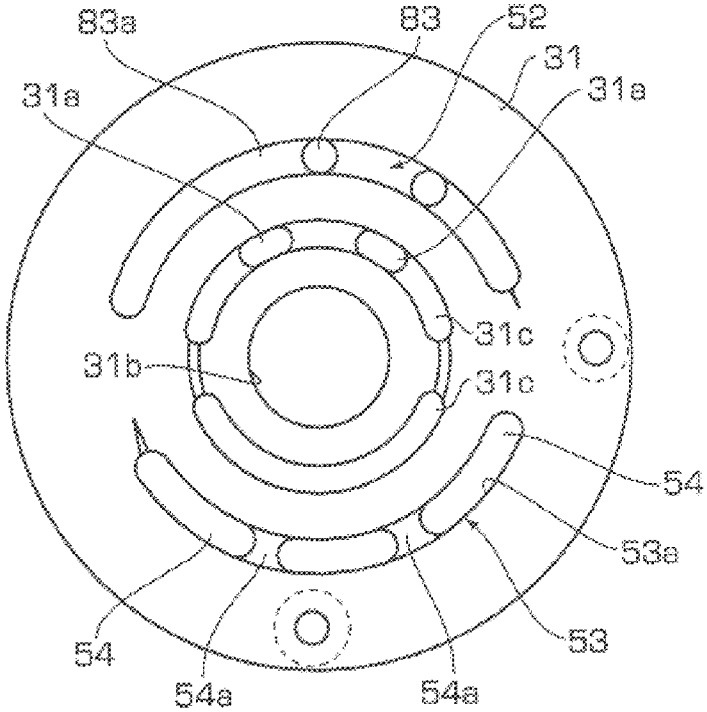

In this embodiment, the pressure plate 31 is arranged as shown in FIGS. 1, 10A and 10B such that a bridge portion 54*a* is provided for at least either (which is discharge-side passage 54 in this case) of the recess groove 83*a* or the discharge-side opening 53 provided for the pressure plate 31 to correspond to the suction-side region 36A and the discharge-side region 36B of the pump chamber 36.

The bridge portions 54*a* is formed in the recess groove 83*a* which is formed into the suction-side opening 52 and the recess groove 53*a* of the discharge-side opening 53, the bridge portions 54*a* being disposed apart from the end surface adjacent to the pump chamber 36.

As shown in FIGS. 10A and 10B, the recess groove 53*a* forming the discharge-side opening 53 has the circular through passage hole (the portion given reference numeral 54). The present invention is not limited to this. A structure shown in FIG. 10C may be employed.

Figure 10C:
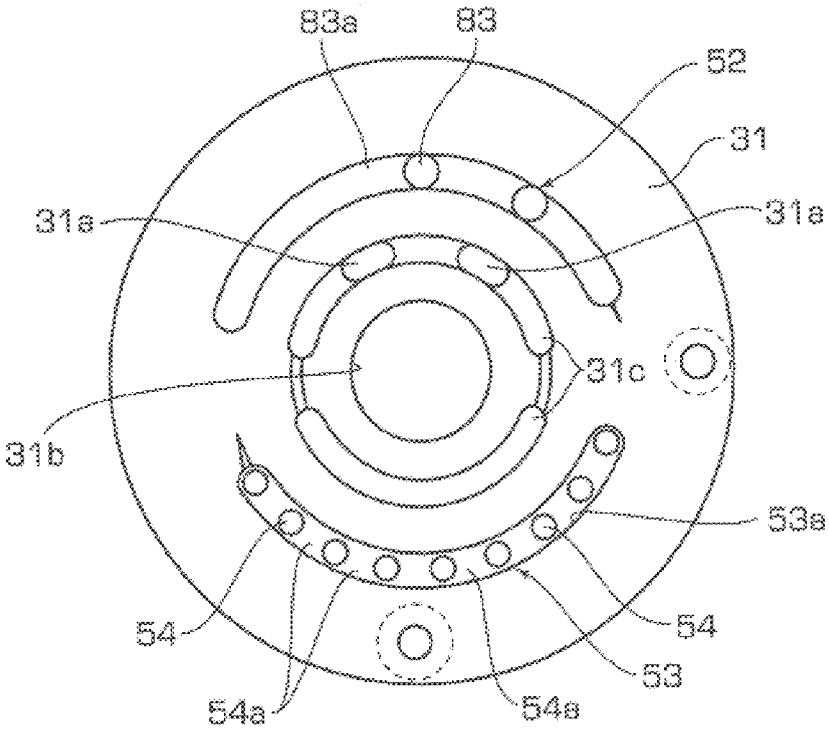

That is, FIG. 10C shows each portion between circular holes 54 which is formed into the bridge portion 54*a* by forming the discharge-side opening (or the suction-side opening 52) of the pump 20 with a plurality of the circular holes 54.

Deterioration in the rigidity of the pressure plate 31 occurring because of the existence of the suction-side opening 52 and the discharge-side opening 53 can be prevented by the bridge portions 54*a*, the suction-side opening 52 and the discharge-side opening 53 having substantially circular-arc shapes provided for the pressure plate 31 to correspond to the suction-side region 36A and the discharge-side region 36B of the pump chamber 36. Thus, required rigidity can be maintained.

The numbers and positions of the bridge portions 54*a* may arbitrarily be determined in consideration of the required rigidity for the pressure plate 31. The suction-side opening 52 and the discharge-side opening 53 having the bridge portions 54*a* can be formed to have arbitrary shapes by molds (or casting molds) When the bridge portions 54*a* are formed by combining the circular holes 54, simple molded holes (cast holed) obtainable when the pressure plate 31 is manufactured may be employed. Thus, the cost can be reduced.

The present invention is not limited by or to the above-mentioned embodiment. The shapes and structures may be modified and changed and a variety of modifications may be employed.

Figure 13:
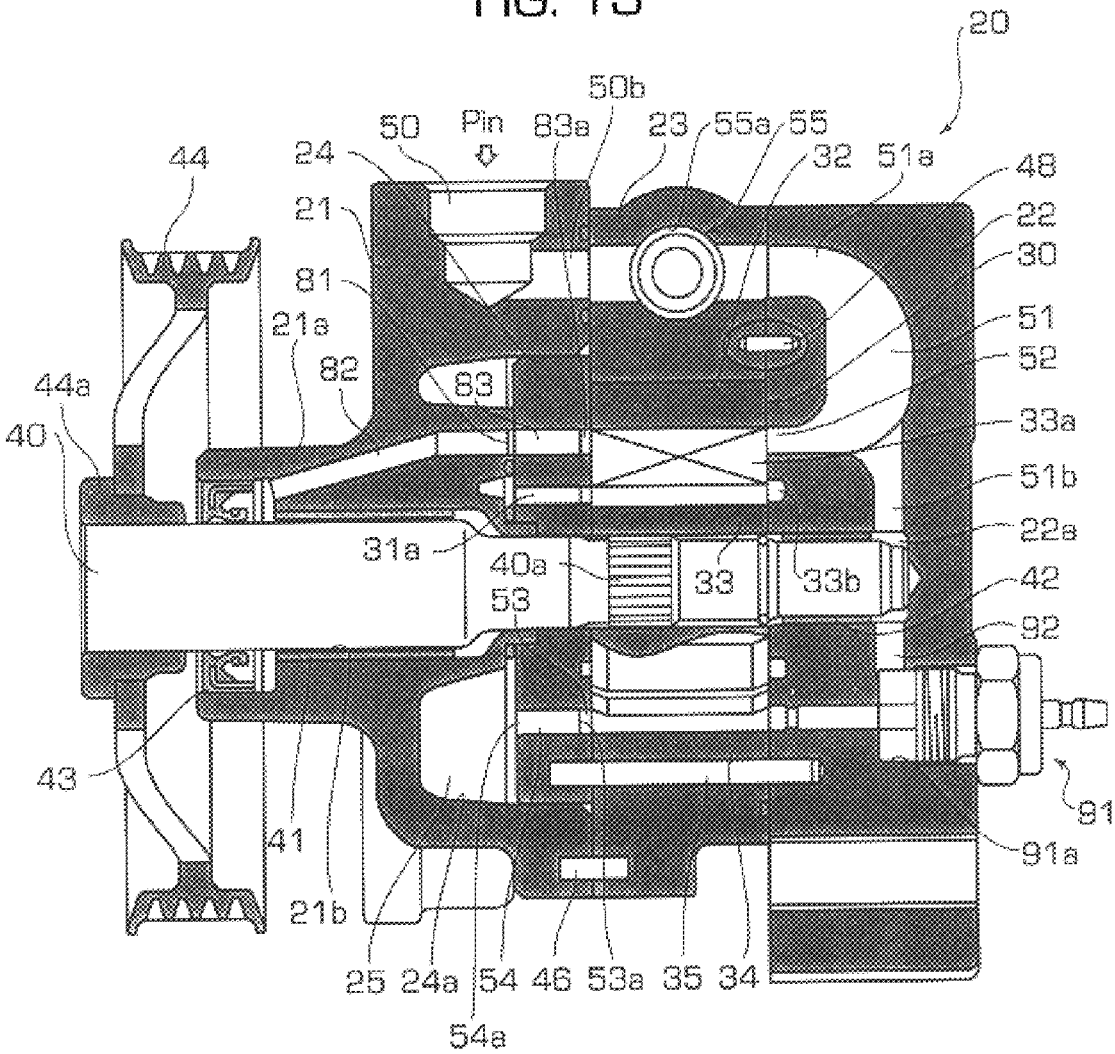
FIG. 13 is a side cross sectional view showing a modification of the variable displacement pump according to the present invention.

Although the above-mentioned embodiment has the structure that the suction port 50 of the pump 20 is provided for the rear body 22, the present invention is not limited to this. The suction port 50 may be provided for the front body 21 so as to be connected to the suction-side passage 51 provided for the rear body 22 through the low pressure portion of the valve hole 55*a* constituting the control valve 55 provided for the cam case 23, as shown in FIG. 13. Reference numeral 50b represents a passage hole for connecting the suction port 50 of the front body 21 to the portion including the cam case 23.

In the structure shown in FIG. 13, the passage 76 for establishing the connection between a portion of the valve hole 75 for the relief valve 74 in the form of a blind hole formed in the rear body 22 to the suction portion of the pump 20 is formed by a core cast hole when the rear body 22 is manufactured by casting. As a result, the processes for forming the passage holes of the rear body 22 can be minimized and an advantage can be obtained when the machining operation is performed, as shown in FIGS. 13 and 14A–14C. Moreover, an advantage can be obtained as compared with the structure shown in FIG. 12 that the blind cap 76*a* can be omitted. As can be understood from a comparison between FIGS. 12 and 14A–14C, the structures of the passages can freely be designed.

Also the passage 92 for connecting, to the suction portion of the pump 20, the low pressure portion of the switch hole 91*a* for receiving the pressure detection switch 91 disposed in a portion of the rear body 22 and arranged to detect a state in which the fluid pressure in the discharge side of the pump 20 has been made to a level not lower than a predetermined level may be formed by using a core in a molding process for casting the rear body 22. In this case, the machining operation can easily be performed and the cost can be reduced.

As described above, the passages 76 and 92 for connecting the low pressure portions of the relief valve 74 and the pressure detection switch 91 to the suction portion of the pump 20 are simultaneously molded by using cores when the rear body 22 is manufactured by casting. Therefore, the number of machining processes and the cost can be reduced.

Figure 15:
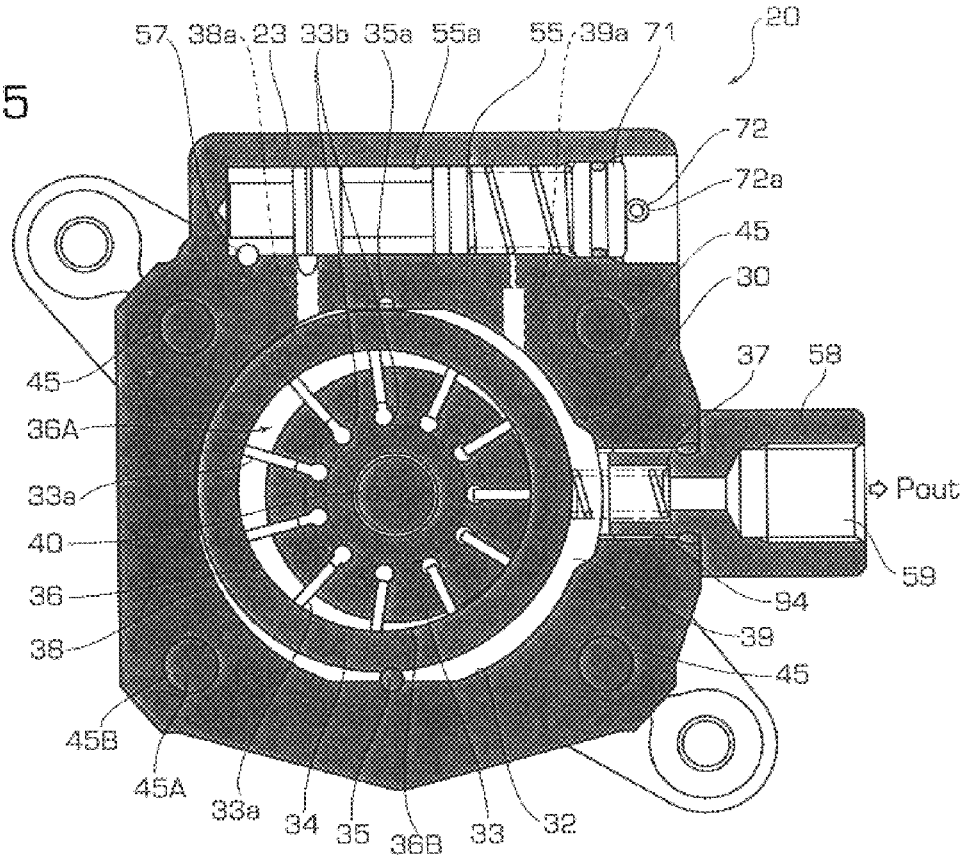
FIG. 15 is a side cross sectional view showing another embodiment of the variable displacement pump according to the present invention.

In the foregoing embodiment, the discharge-side connector 58 having the discharge-side port 59 and disposed in the discharge portion of the pump 20 has the structure that the discharge side port 59 is opened in the direction perpendicular to the axial direction of the discharge-side connector 58, as shown in FIG. 3. The present invention is not limited to this. A simple structure may be employed in which the discharge-side port 59 is opened in the axial direction of the discharge-side connector 58, as shown in FIG. 15.

The vane-type variable displacement pump 20 having the above-mentioned structure is not limited to the above-mentioned embodiment. The pump 20 may be applied to any one of various apparatuses and units as well as the power steering unit according to the embodiment.

As was described above, the variable displacement pump according to the present invention is able to keep the oil pressure balance between the two sides of the pressure plate 31 having one side surface which is contact with the pump chamber 36 and the other ends surface on which the pump discharge chamber is formed. Thus, deformation of the plate can be prevented.

According to the present invention, determination of the area of the region which is formed into the low pressure chamber for the low level hydraulic pressure realized by a recess enables an amount of internal leakage occurring when the pressure level is high by using adequate deformation of the pressure plate.

What is claimed is:

1. A variable displacement pump comprising:

a cam ring for forming a pump chamber from a rotor in a state where said rotor having a vane is moved to an eccentric position;

a cam case mounted on a portion around said cam ring to swingably support said cam ring such that a swingable pin axially disposed in a portion of an outer periphery of said cam ring in a circumferential direction of said cam ring serves as a fulcrum so that the capacity of said pump chamber is changed, said cam case urging said cam ring in a direction in which the capacity of said pump chamber is maximized;

front and rear bodies between which said cam case serving as an intermediate body is disposed and which are disposed on the two sides in the axial direction of said cam case so as to form a pump today;

a rotational shaft pivotally supported by said front and rear bodies so as to rotate said rotor; and a pressure plate disposed on the inside of said front body at a position at which said pressure plate is in contact with a portion adjacent to said cam case so as to introduce pressurized oil in a discharge portion of the pump to a back surface of said pressure plate;

wherein a low pressure chamber for introducing low level oil pressure is formed at a position opposite to a suction region of said pump chamber; and wherein said low pressure chamber is surrounded by a discharge chamber.

2. A variable displacement pump according to claim 1, wherein said pressure plate comprises a bridge portion, a suction-side opening and a discharge-side opening, said bridge portion, said suction-side opening and said discharge-side opening having substantially circular-arced shapes.

3. A variable displacement pump according to claim 1, wherein a relief valve for relieving hydraulic oil to a suction side of said pump and a pressure detection switch for detecting fluid pressure in said pump are formed in said rear body, and passages which connect said relief valve and said pressure detection switch to said pump are machine-formed in said rear body.

4. The variable displacement pump according to claim 1, further comprising a sealing member which seals the low pressure chamber from a portion adjacent to the discharge portion of the pump.

5. A variable displacement pump according to claim 1, further comprising a passage which introduces low pressure oil into said low pressure chamber.

* * * * *